US010584076B1

(12) United States Patent
Luan et al.

(10) Patent No.: US 10,584,076 B1
(45) Date of Patent: Mar. 10, 2020

(54) PYROPHORIC FOAM MATERIALS AND METHODS OF MAKING THE SAME

(71) Applicant: U.S. Government as Represented by the Secretary of the Army, Picatinny Arsenal, Dover, NJ (US)

(72) Inventors: Zhaohua Luan, Roxbury, NJ (US); Kendall C. Mills, Blairstown, NJ (US); Lauren A. Morris, Midland Park, NJ (US); Christopher D. Haines, Union, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/992,624

(22) Filed: May 30, 2018

Related U.S. Application Data

(62) Division of application No. 14/940,775, filed on Nov. 13, 2015, now Pat. No. 10,059,637.

(51) Int. Cl.

| | |
|---|---|
| ***C06B 45/10*** | (2006.01) |
| ***C06B 45/00*** | (2006.01) |
| ***C06B 45/04*** | (2006.01) |
| ***C06C 15/00*** | (2006.01) |
| ***C06B 21/00*** | (2006.01) |
| *C06B 45/06* | (2006.01) |
| *C06B 45/08* | (2006.01) |
| *D03D 23/00* | (2006.01) |
| *D03D 43/00* | (2006.01) |

(52) U.S. Cl.
CPC ..... *C06B 45/04* (2013.01); *C06B 21/0058* (2013.01); *C06B 45/00* (2013.01); *C06C 15/00* (2013.01)

(58) Field of Classification Search
USPC ..... 149/2, 17, 18, 19.1, 20, 108.6, 109.4
See application file for complete search history.

(56) References Cited

U.S. PATENT DOCUMENTS

2010/0139823 A1* 6/2010 Gash ..... C06B 45/00 149/17
2012/0028798 A1* 2/2012 Worsley ..... B01J 21/18 502/439

OTHER PUBLICATIONS

Huber, Dale L., Synthesis Properties and Application of Iron Nanoparticles, Small, 2005, pp. 482-501, 1, No. 5, Wiley-VCH Verlag GmbH & Co. KGaA, Weinheim.
Doorenbos, Zac, Pyrophoric Porous Self-Supporting Substrates with Tunable Thermal response, Proceedings of the International Pyrotechnics Seminar, 2011, 37th (EUROPYRO 2011).
Doorenbos, Zac, Novel Pyrophoric Substrates with a Tunable Energetic Output, AIChE Annual Meeting, Conference Proceedings, Salt Lake City, UT, U.S., Nov. 7-12, 2010.
Shende, R., Formation of Pyrophoric a-Fe Nanoparticles from Fe(II)-Oxalate, NSTI Nanotech, Nanotech. Conf. and Trade Show, Tech. Proc, Jun. 1-5, 2008 (2008), 1, 692-695, Bosto.
Evans, J.P., Pyrophoricity of Fine Metal Powders, Powder Metallurgy, 1976, 19(1), 17-21.

* cited by examiner

*Primary Examiner* — James E McDonough
(74) *Attorney, Agent, or Firm* — Lisa H. Wang

(57) ABSTRACT

An in-situ process for synthesizing highly pyrophoric foam materials using metal and carbon precursors wherein the precursors serve as foaming and activating agents to disperse and lock nano-sized metal particles within a rigid porous carbon matrix. The resulting carbon matrix is also pyrophoric.

6 Claims, 4 Drawing Sheets

PYROPHORIC FOAM MATERIALS AND METHODS OF MAKING THE SAME

RELATED APPLICATIONS

This application is a division of, and claims the benefit of, co-pending U.S. patent application Ser. No. 14/940,775, filed Nov. 13, 2015, the contents of which are incorporated herein in its entirety.

RIGHTS OF THE GOVERNMENT

The inventions described herein may be manufactured and used by or for the United States Government for government purposes without payment of any royalties.

FIELD OF INVENTION

An in-situ method for synthesizing highly pyrophoric foam materials, in which precursor chemicals with potential to form pyrophoric metal particles and highly porous carbon foams, respectively, are uniformly mixed, with or without aid of a solvent, to produce a paste, cast into any geometry desirable for a specific application, and subjected to further thermal treatments for curing and activation. This leads to the formation of foam materials with pyrophoric metal particles embedded uniformly into a highly porous carbon matrix which is also pyrophoric in nature.

BACKGROUND OF THE INVENTION

Finely powdered iron metal particles are pyrophoric as they can ignite and burn spontaneously upon direct contact with the air. The reaction is highly exothermic and self-sustainable, in which the iron particles react naturally with the oxygen in the atmosphere to form iron oxides, which is otherwise commonly known as the "rusting of steels". The reactivity of the iron metal particles in the air has, however, been found to be largely a function of its particle sizes and the corresponding surface areas available to react with the oxygen in the atmosphere. Another important aspect of very fine iron particles, as with any nanosized metal powders, is its natural tendency to aggregate or sinter at elevated temperature to form larger particles resulting in dramatic loss of its pyrophoric properties.

Therefore, significant efforts have been made over past decades to segregate and stabilize nanosized iron particles on various substrates with large surface areas, such as metallic foils, non-combustible fiber meshes, activated carbons, zeolites, and, most recently, carbon nanotubes, etc. The resulting pyrophoric materials, in various forms, have been an important subject in a wide array of applications such as cathode materials for fuel cells, active agent in chemical sensing device, and catalysts for ammonia synthesis, liquid-phase hydrogenation reactions for fine chemicals, and groundwater remediation, etc. Once passivated slightly in controlled environments, certain pyrophoric iron materials have found applications as pigments for magnetic tapes and in medical practice for its bacteriostatic properties. In military, pyrophoric iron materials have long been considered as the primary pyrotechnic charges in pyrophoric penetrator, ammunition training round markers, and infrared aerial decoy devices against heat-seeking missiles.

Pyrophoric iron particles found on various substrates are well documented, but most of those substrates reported in the literature do not actually provide the kind of confinement down to nanometer scales to prevent aggregation and sintering of fine particles at elevated temperature, as is the case with metallic foils and fabric materials. The pyrophoric iron composite materials thus obtained are normally dusty in nature, and the loading of active iron ingredients and the thermal activation are considered extremely delicate processes. In the cases of substrates with highly porous structures, such as zeolites or activated carbons, the transportation of the precursor iron ingredients into the existing narrow channels, less than 0.7 nm or around 1.0 nm of zeolites or activated carbons respectively, is severely hindered, so is its interaction with oxygen in air as pyrophoric materials. For instance, Gash et al, U.S. Patent Application Publication No. 2010/0139823, discloses methods for creating pyrophoric materials by first heating a carbon foam to create micropores, then depositing liquid solution containing metal ions into the micropores. This results in overall lower loading of pyrophoric iron particles and limited reactivity, and this class of materials is reported mostly as catalysts rather than pyrophoric materials.

The present invention provides an alternative approach to make pyrophoric foam materials by disclosing a simple in-situ or one-pot process for making pyrophoric foam materials in which the precursor chemicals with potential to form pyrophoric metal particles and porous carbon materials, respectively, are uniformly mixed, with or without a solvent, to produce a paste, molded or casted into any desirable geometry. Further thermal treatments results in the formation of the pyrophoric foams with pyrophoric metal particles uniformly distributed in a highly microporous carbon matrix which are also pyrophoric in nature.

SUMMARY OF THE INVENTION

Finely powdered iron metal particles are pyrophoric but naturally tend to aggregate or sinter when exposed to elevated temperature to form larger particles with reduced reactivity. Efforts have been made to stabilize nanosized iron particles on various substrates with large surface areas, but with limited success. In this invention, a simple one-pot or in-situ synthesis route for extremely pyrophoric foam materials is disclosed, in which precursor metal molecules (or clusters) are first well dispersed into a polymeric matrix, followed by thermal treatments to produce pyrophoric metal nanoparticles formed through simultaneous carbonization of the polymeric matrix. Since the decomposition of the precursor metal molecules (or clusters) and the carbonization of the polymeric matrix occur simultaneously, the synergy between these chemical reactions is fully exploited to complete the carbonization process. For instance, the gaseous products from the decomposition of the metal precurors serve as foaming and activation agents for the carbonization of the polymeric matrix, while the evolving carbon matrix is being continuously carved to segregate the newly formed pyrophoric iron particles. Upon contact with the air, the foam materials are highly pyrophoric and burn intensely; both the pyrophoric iron nanoparticles and the microporous carbon matrix are highly flammable and contribute to the total heat output.

BRIEF DESCRIPTION OF THE DRAWINGS

Further features and advantages of the present invention may be understood from the drawings.

DETAILED DESCRIPTION

Figure 1:
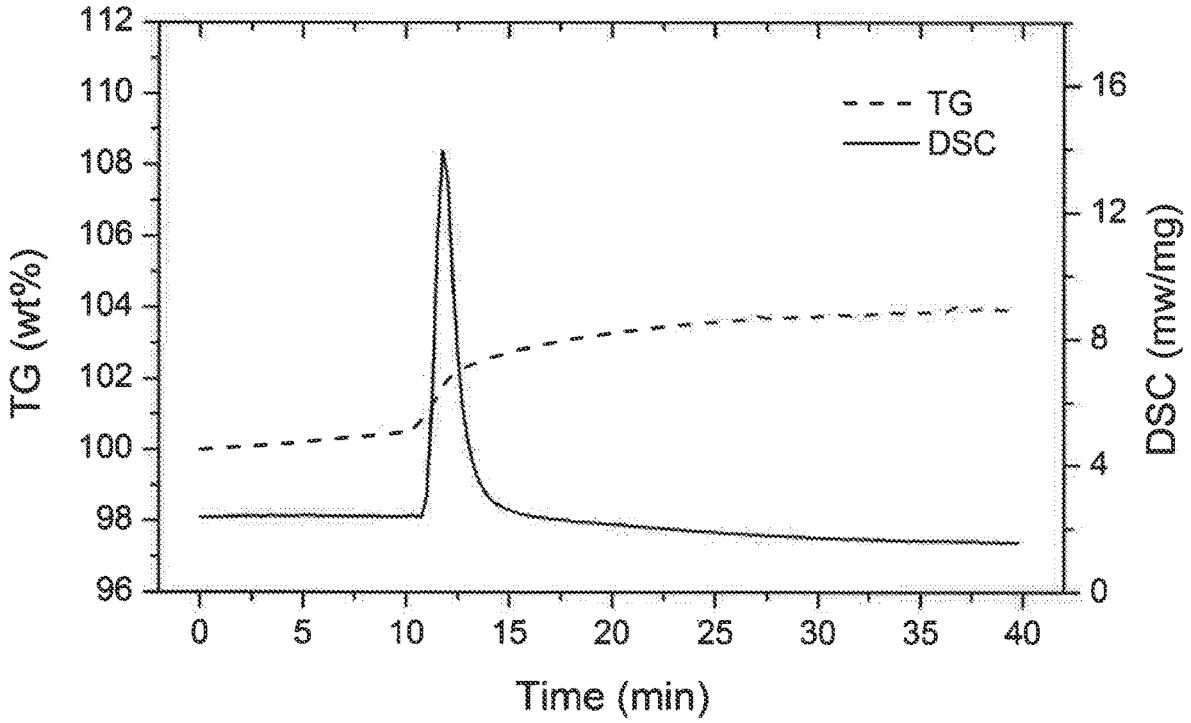
FIG. 1. Thermogravimetric (TG) and differential scanning calorimetry (DSC) measurement of the pyrophoric foam upon exposure to air flow at ambient condition. The pyrophoric foam was produced in a gas flow of 5% hydrogen in argon.

A simple one-pot synthesis route is disclosed for extremely pyrophoric foam materials wherein precursor metal molecules or clusters are first well dispersed into a polymeric matrix, followed by thermal treatments to produce pyrophoric metal particles formed through simultaneous carbonization of the polymeric matrix. The process exploits the synergy of the decomposing precursor metal molecules or clusters with the carbonization of the polymeric matrix into a simultaneous process. For instance, the gaseous products from the decomposition of the metal precurors serve as foaming and activation agents for the carbonization of the polymeric matrix, while the evolving carbon matrix is being continuously carved to segregate the newly formed pyrophoric metal particles. Upon contact with the air, the pyrophoric foam materials thus obtained burn intensely; both the pyrophoric metal nanoparticles and the carbon matrix are highly flammable and contribute to the total heat output.

The articles "a" and "an" are used herein to refer to one or to more than one (i.e. to at least one) of the grammatical object of the article. By way of example, "a metal" means one metal or more than one metal.

The in situ or one pot process for preparing a pyrophoric foam material comprises the steps of (a) mixing a precursor composition comprising precursor metal molecules, carbon precursor, and solvent into a homogenous paste, (b) casting the homogenous paste, (c) curing the homogenous paste and (d) activating the cured homogenous paste into a porous carbon matrix uniformly embedded with nano-sized metal particles by heating the cured homogenous paste at elevated temperatures under an inert or reducing atmosphere.

In the present invention, the precursor metals molecules are compounds with atomically isolated metal ions, such as inorganic metal salts of iron, aluminium, bismuth, boron, calcium, hafnium, iron, magnesium, manganese, tin, titanium, cobalt, uranium, zinc, zirconium, etc., organometallic molecules with charged or uncharged metal elements counter-balanced with a number of organic legands. Examples of the inorganic metal salts include, not limited to, iron oxalate dihydrate and aluminium sulfate, while the organometallic compounds refer to organic metal molecules such as, but not limited to, triethylaluminum and ferrocene. A preferred precursor metal is iron oxalate dihydrate.

The selection of carbon precursors for the polymeric matrix should be determined based on its ability to crosslink upon thermal treatment and form highly porous carbon foam. Carbon precursors, such as petroleum pitch and carbohydrates such as starch and sugars, are acceptable. Resole phenolic resin is preferred as it has excellent solubility in certain solvents for easy processing and is moldable as a thermoset polymer into any desirable geometry prior to further thermal treatments.

Solvents should be selected for its ability to promote uniform mixing of the precursor chemicals for pyrophoric metal molecules and the carbon foams. Ethanol is a preferred solvent. When ethanol is used as a solvent, the amount may vary from 5 to 10 ml for a 10 g batch of precursor composition mix, depending on the desired viscosity and/or density of the paste.

The pyrophoric foam composition can be molded and fabricated into predefined geometric shapes prior to thermal activation such as pellets, thin disks, beads, granulars, monoliths with large channels and cavities. Curing the molded homogenous paste comprising the metal and carbon precursor can be achieved by heating the composition at about 50° C. to about 200° C., preferably about 100° to about 160° C. Activating the cured homogenous paste to produce the pyrophoric microporous foam material can be achieved by heating the composition to about 400° C. to about 800° C. under an inert or reducing atmosphere.

The ratio of the precursor chemicals to produce the pyrophoric microporous foams, can be adjusted accordingly to achieve a targeted loading of the pyrophoric metal particles in the carbon foams for desirable structural and pyrophoric properties. For the pyrophoric foams produced with iron oxalate dihydrate as the metal precursor and thermoset phenolic resin as carbon precursor, a preferred ratio is between about 10.0 to 1.0. With measured weight losses of approximately 69% and 50% for iron molecules and carbon precursors, respectively, upon thermal treatment to produce phrophoric foams, an iron/carbon weight ratio in a range of about 6.2 to 0.62 can be obtained for the final foam materials. The pyrophoric foam materials containing porous carbon matrix with embedded metal nanoparticles produced by the process described herein may be maintained or stored under an inert or reducing atmosphere to to preserve its reactivities toward the air or an oxidizing atmosphere.

The utility of this invention is well demonstrated in the examples below, though the weight ratios of precursor materials could be adjusted in a wide range for desirable properties for any particular applications. The curing and thermal treatment conditions could also be varied in a range well documented in prior arts for carbonization of carbon precursors.

Example 1

Iron oxalate dihydrate was used as the metal precursor. Analysis revealed that it yields 20% water and 49% carbon dioxide as gases, and 31% metal iron particles by weight after being heated to 450° C. where a complete decomposition was observed. The carbon precursor was a resole phenolic resin from Georgia-Pacific Chemicals LLC, coded GP-5520, which showed a carbon yield of ~50% by weight after mixed with ethanol to produce a paste, the homogenous paste was cured at 160° C. overnight, and heated in inert gas to up to 800° C.

In a typical sample preparation, 10 g of iron oxalate dihydrate was combined and mixed with 3 g of the resole phenolic resin, and 5 ml of dry ethanol was then added into the mix with vigorous stirring to produce a homogenous paste. The paste could be left drying in air at room temperature or molded into any desirable geometry, and/or transferred into an oven for curing at 160° C. for 12 hours to produce a composite material with rigid structure. The cured composite was further subjected to activation by heat treatment at 500° C. for 30 minutes in the constant flow of 5% hydrogen in argon to yield a highly porous foam product. In-situ analysis showed that the iron oxalate gave off water and carbon dioxide gases as the decomposition reaction proceeded, as does the resole phenolic resin through further structural crosslink and carbonization.

After cooling down to ambient temperature of around 30° C. and upon exposure to air flow, the foam burned immediately with intense heat output, as shown in FIG. 1, indicating spontaneous self-ignition at ambient temperature. The reaction was accompanied with significant weight gain indicating combustion of pyrophoric iron particles to iron oxides.

Example 2

Figure 2:
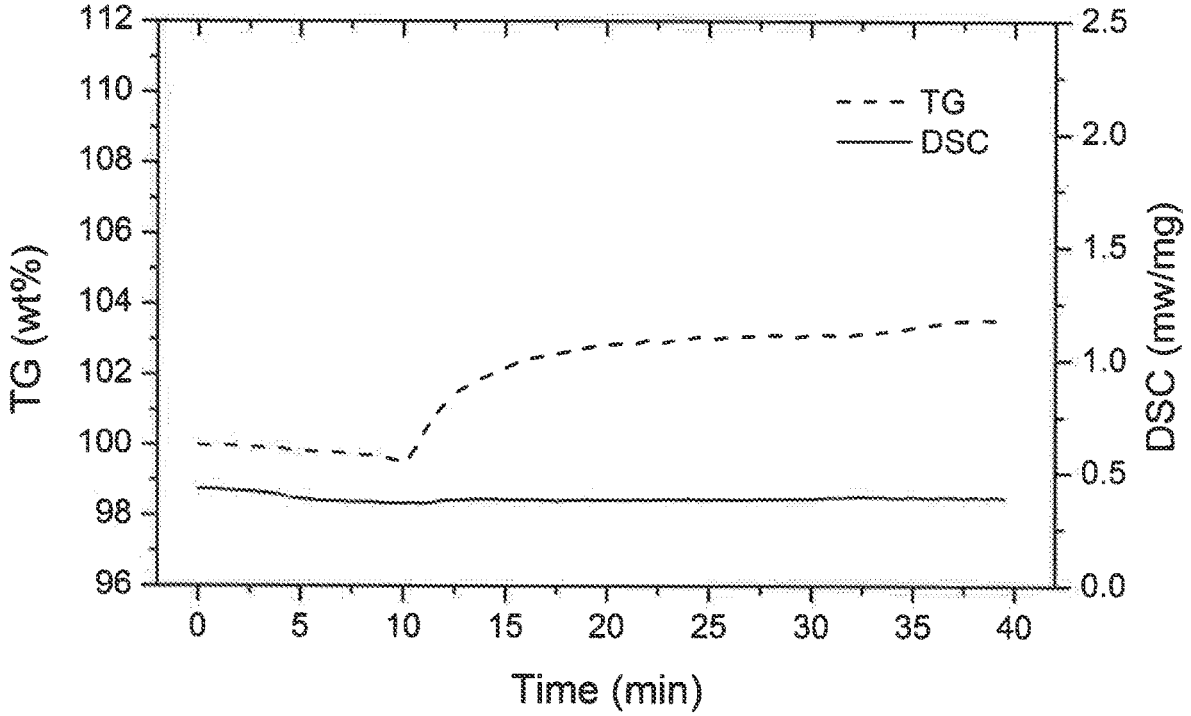
FIG. 2. Thermogravimetric (TG) and differential scanning calorimetry (DSC) measurement of the iron particles from pure iron oxalate upon exposure to air flow at ambient condition. The iron particles were produced through direct decomposition of iron oxalate in a gas flow of 5% hydrogen in argon.

In FIG. 2, a powder sample prepared from pure iron oxalate, subjected to the same thermal treatments, did not show any signs of self-ignition with heat output, though a weight gain was also observed, indicating a slow reaction (smoldering) of iron particles with air to form iron oxides. The results confirm that the pyrophoric foam materials disclosed in this invention is remarkably more pyrophoric than the iron powders produced otherwise.

Example 3

Figure 3:
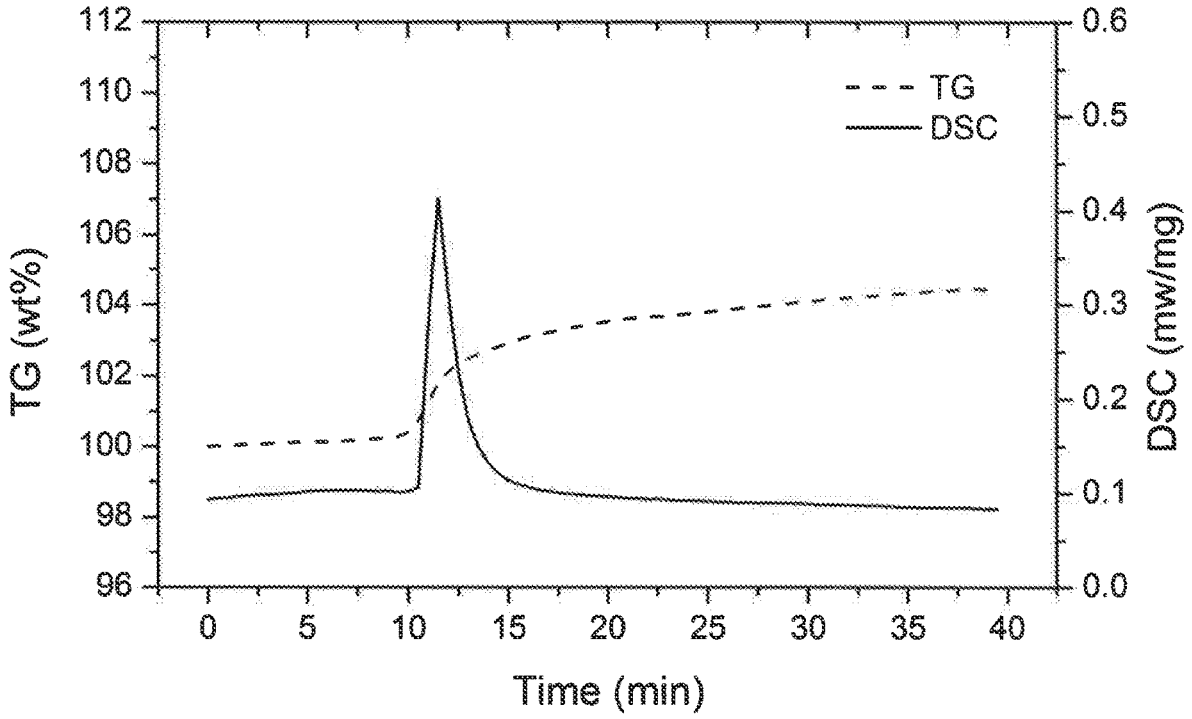
FIG. 3. Thermogravimetric (TG) and differential scanning calorimetry (DSC) measurement of the pyrophoric foam upon exposure to air flow at ambient condition. The pyrophoric foam was produced in a gas flow of pure argon.

In FIG. 3, a cured composite was prepared the same as demonstrated in example 1, but was subjected to heat treatment at 500° C. in the constant flow of pure argon instead of 5% hydrogen in argon. After cooling down to ambient temperature of around 30° C. and exposed to air flow, the foam material burned spontaneously but with reduced heat output as compared to the one treatment in gas of 5% hydrogen in argon.

Example 4

Figure 4:
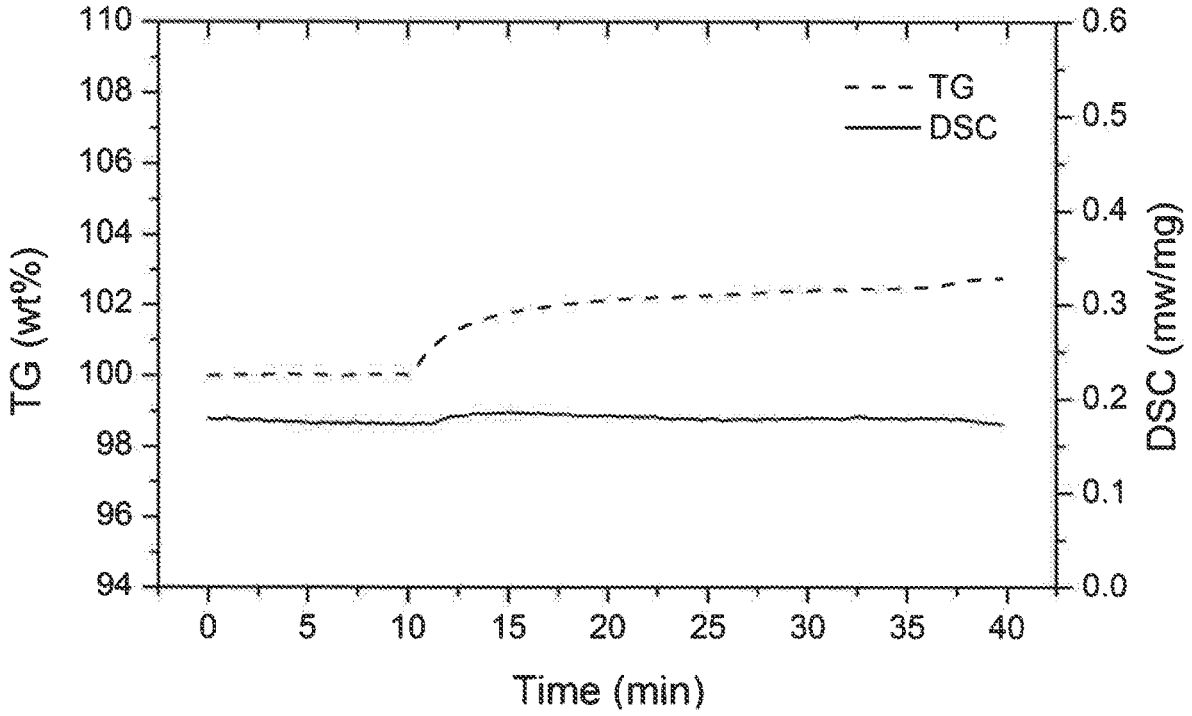
FIG. 4. Thermogravimetric (TG) and differential scanning calorimetry (DSC) measurement of the iron particles from pure iron oxalate upon exposure to air flow at ambient condition. The iron particles were produced through direct decomposition of iron oxalate in a gas flow of pure argon.

In FIG. 4, a powder sample prepared from pure iron oxalate following same thermal treatments in pure argon did not show any signs of self-ignition but a slow weight gain was still observed. The results further confirm that the pyrophoric foam materials disclosed in this invention possess more pyrophoric iron particles than the ones produced otherwise.

While embodiments have been set forth as illustrated and described above, it is recognized that numerous variations may be made. Therefore, while the invention has been disclosed in various forms only, it will be obvious to those skilled in the art that additions, deletions and modifications can be made without departing from the spirit and scope of this invention, and no undue limits should be imposed, except as to those set forth in the following claims.

What is claimed is:

1. A pyrophoric foam composition consisting essentially of a predefine geometric shape porous carbon matrix, wherein the carbon matrix is selected from the group consisting of phenolic resin, petroleum mesopitch and carbohydrate and wherein the carbon matrix comprises pyrophoric metal nanoparticles uniformly embedded throughout said porous carbon matrix, wherein said foam composition is maintained in an inert or reducing atmosphere.

2. The composition of claim 1 wherein the pyrophoric metal nanoparticles consists essentially of iron.

3. The composition of claim 1, wherein the pyrophoric metal nanoparticle comprises iron, aluminum, bismuth, boron, calcium, hafnium, iron, magnesium, manganese, tin, titanium, cobalt, uranium, zinc, and/or zirconium.

4. The composition of claim 1, wherein the pyrophoric metal nanoparticle comprises iron.

5. The composition of claim 1, wherein the carbon matrix is resole phenolic resin.

6. The composition of claim 1, wherein the pyrophoric metal nanoparticle comprises triethylaluminum or ferrocene.

* * * * *